US006805679B2

(12) United States Patent
Winkley

(10) Patent No.: US 6,805,679 B2
(45) Date of Patent: Oct. 19, 2004

(54) HYDROCUSSION MASSAGER

(76) Inventor: Christopher Thomason Winkley, 318 Seabright Ave., Santa Cruz, CA (US) 95062

( * ) Notice: Subject to any disclaimer, the term of this patent is extended or adjusted under 35 U.S.C. 154(b) by 120 days.

(21) Appl. No.: 10/162,931

(22) Filed: Jun. 6, 2002

(65) Prior Publication Data

US 2003/0229300 A1 Dec. 11, 2003

(51) Int. Cl.[7] ..... A61H 1/00; A61H 23/02; A61H 33/00

(52) U.S. Cl. ..... 601/111; 601/155; 601/160; 601/169

(58) Field of Search ..... 601/108, 110, 601/111, 154, 160, 161, 155, 159, 169; 239/383, 667, 449, 289, 380, 548, 553.3, 558; 4/541.3, 575.1, 606, 615

(56) References Cited

U.S. PATENT DOCUMENTS 1,840,812 A * 1/1932 Hardy ..... 601/155
1,948,167 A * 2/1934 Cornwell ..... 601/155
2,905,171 A * 9/1959 De Crescenzo ..... 601/160
3,924,808 A * 12/1975 Cooley, Jr. ..... 601/154
4,709,691 A * 12/1987 Lemons et al. ..... 601/160
5,385,532 A * 1/1995 Shyu ..... 601/160
5,467,927 A * 11/1995 Lee ..... 239/383
5,662,593 A * 9/1997 Tillman et al. ..... 601/159
5,807,289 A * 9/1998 Camp ..... 601/160
6,213,964 B1 * 4/2001 Pesovic et al. ..... 601/160

* cited by examiner

*Primary Examiner*—Danton D. DeMille
*Assistant Examiner*—Quang D Thanh

(57) ABSTRACT

The Hydrocussion Massager is a handheld electronic massager that uses both percussion and water pressure massage to give the user a great tool for therapeutic relaxation. The device is a handy easy-to-use tool that is easily connected to any showerhead or appropriate faucet. It uses three speeds of percussion massage and different levels of water pressure from a specially designed showerhead inside the massager. It is waterproof and cordless, but it is connected to a hose, which channels the water from a faucet into the massager.

2 Claims, 6 Drawing Sheets

HYDROCUSSION MASSAGER

SPECIFICATION

The invention is a handheld massager that can provide a percussion massage and a water pressure massage simultaneously. The manufacturing process includes fabricating the functioning components as well as a molded plastic case to house the components. These components include an electric motor with attachments to rubber heads, a rechargeable battery, a small circuit board, wires connecting the battery to the circuit board and back to the battery, a water hose, and the water showerhead. Other parts being produced are a plastic molded handle, a rechargeable battery unit, and a fitted showerhead for the plastic mold.

The invention is implemented by attaching the showerhead massager to a standard water faucet or shower supply line. The massager control setting is turned to a desired speed. When the water is turned on, the massager is rubbed over the body for relaxation therapy. The massager is powered by a rechargeable battery, which also has a rechargeable battery stand that is plugged into the wall by an electric cord.

BACKGROUND OF THE INVENTION

The product pertains to the Massage and Vibrators classification section (D24/215). The background of the product is based on the idea of combining two massage tools into one product. This tool of mechanical massage brings a percussion massager together with a unique showerhead that uses water pressure for massage relief. Each of the massage tools has unique capabilities to relieve muscle pain. The Hydrocussion Massager is unlike any other massager used in a therapeutic environment with regards to its potential for deep muscle relief.

BRIEF SUMMARY OF THE INVENTION

The general idea of the Hydrocussion Massager is to be used for personal relaxation and physical stress relief. The product combines the techniques of a percussion massager and showerhead massager into one product. Having the technical abilities of a percussion and showerhead massager in one product is the advantage of the Hydrocussion Massager. The use of the product can combine the therapeutic effects of hot water, strong water pressure, and percussion massage to create a unique way of relieving muscular and physical pain. It stimulates the deep muscle relief found in a powerful handheld massager and translates that action into the shower.

DETAILED DESCRIPTION OF THE INVENTION

Figure 1:
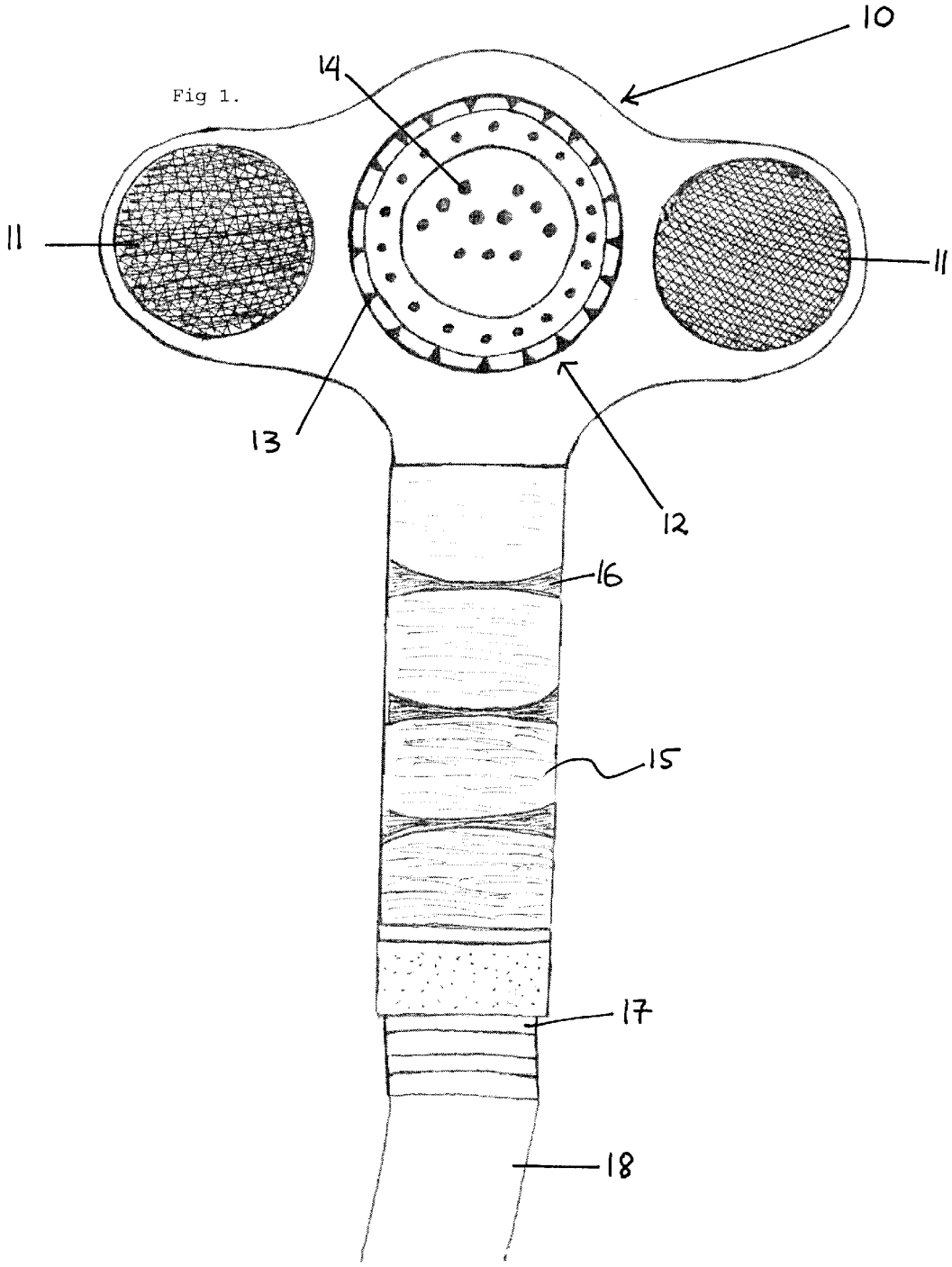
FIG. 1. This is the front side of the massager, the side used on the body. The black rubber balls are used to perform percussion massage. The large circle in the center of the device is the specially designed showerhead that fits inside the massager and performs water pressure massage.

The Hydrocussion Massager consists of a cordless electric percussion massager and a specially made showerhead with different levels of pressure and spray type. The two sources of massage come together to form one device. The purpose of this device is to enable a person to work with a deeper mechanical massager in an aquatic environment for serious muscle relief. The source of this invention originates in the recognized value of hydrotherapy for muscle relaxation. The dual components of temperature and pressure are combined in this device to make it unique. The specific improvement of this device compared to other massagers used in the shower is its ability to use two sources of mechanical massage simultaneously in water.

The process of making the device involves assembling a variety of parts to fit and work in a specially designed plastic mold case. These parts are: a specially designed percussion massage motor, a circuit board connecting a plastic percussion speed adjuster piece, wires connecting the electrical circuit, a specially formed and fitted re-chargeable battery, a plastic handle with hand grip and a hose running to a showerhead. A hose with screw-in attachments will run from the water faucet into the handle and connect with the hose inside the handle which leads to the showerhead. The massager will be water resistant from the specially designed plastic molded case and the necessary adjustments of the product.

The electric portion of the Hydrocussion Massager is made by first creating a plastic mold that can fit the parts in a convenient and useable manner according to the drawings of the product. The Hydrocussion Massager will be powered by a rechargeable battery. Insulated wires will connect the electrical circuit between the battery, the speed adjuster switch and the electric motor that runs the massager. A special circuit board will be used on the back of the speed adjuster and will control the level of voltage brought to the motor. A battery re-charging stand will be used to re-charge the battery. This section comprises the electronic part of the massager.

The use of water pressure is another part of this design. Water comes from a hose that runs up the handle of the massager and into the center of the front of the massager where it distributes the water into a specially formed showerhead. The showerhead has special designed plastic plates that rotate and give the user different levels of water pressure and other spray options. Water will not be brought into the device because of a specially designed plastic molded case, a series of plastic doors that seal the entrance to the battery, and rubber modifications that seal any water passage into the electrical part of the device.

The combination of water pressure and percussion massage features in this product creates a unique way to relieve muscular tension while showering or bathing. Along with the healing effects of hot or cold water, the use of the massager will give a person an amazing therapeutic experience. The use of the Hydrocussion Massager is an easy way to relax through the trials of life.

Views of the Drawings

FIG. 1. This is the view of the front of the massager 10. The angle that this picture depicts is what the massager would look like if you were bringing the massager closer towards yourself for use. The black circles represent the rubber massage heads 11. The circle in the middle of the page with many small circles and triangles is the showerhead 12 part of the massager. The triangles 12 represent the part of the showerhead that rotates so the device can perform other water features. The small circles 14 represent the places where water can exit the showerhead, changing from a sprinkle to a stronger pressurized spray. The handle 15 is represented by the shaded area. The small crevices moving horizontally on the handle are part of a rubber grip pad 16 used to hold the massager. The crevices are special places on the grip pad that are designed to fit four fingers of a hand. The bottom of the handle represents the connection between the screw 17 on the end of the handle and the water hose 18 that brings water into the massager.

Figure 2:
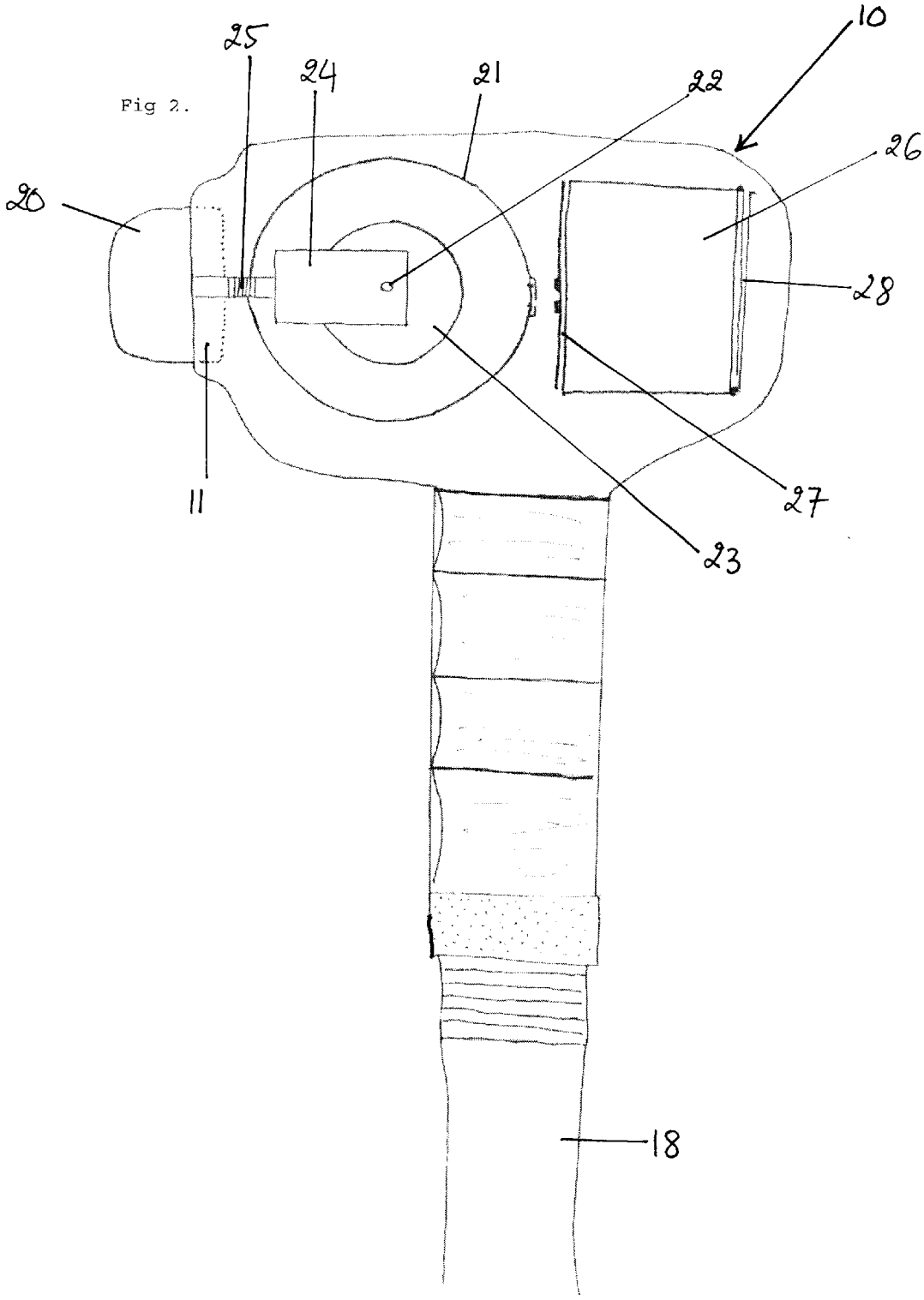
FIG. 2. This is the left side of the massager. This view is of the electric percussion motor (on the left), and of the rechargeable battery. This view depicts how the motor and the battery will fit inside the head of the device.

FIG. 2. The view given shows the massager from the left without the left side of the plastic case, and only shows the battery and electric percussion motor. Starting from the far left, the cylindrical shaped object that is connected with dots is the rubber head 11 of one of the two percussion massage heads 20. The dots represent what space the rubber head would fill if it were drawn inside the plastic case. The large circle is the electric motor 21; it has metal rods 22 coming from it that connect to the smaller plastic circle 23 next to it. This smaller circle spins with the turning of the rod, and makes the rectangle plastic piece 24 oscillate up and down, which is attached to the small spinning circle 23, as know in the art. The rectangular piece has a screw 25 that attaches it to the rubber head, and as the rectangular piece 24 and screw 25 move up and down, so does the rubber head.

The right side of the interior view is filled with a rechargeable battery 26. The left side of the battery is the electrical conducting plate 27 that connects the electrical circuit in the massager with the battery. To the right side of the battery are two plastic doors 28 that enclose the battery in a plastic case that is resistant to water. The view of the handle is the same as in FIG. 1.

Figure 3:
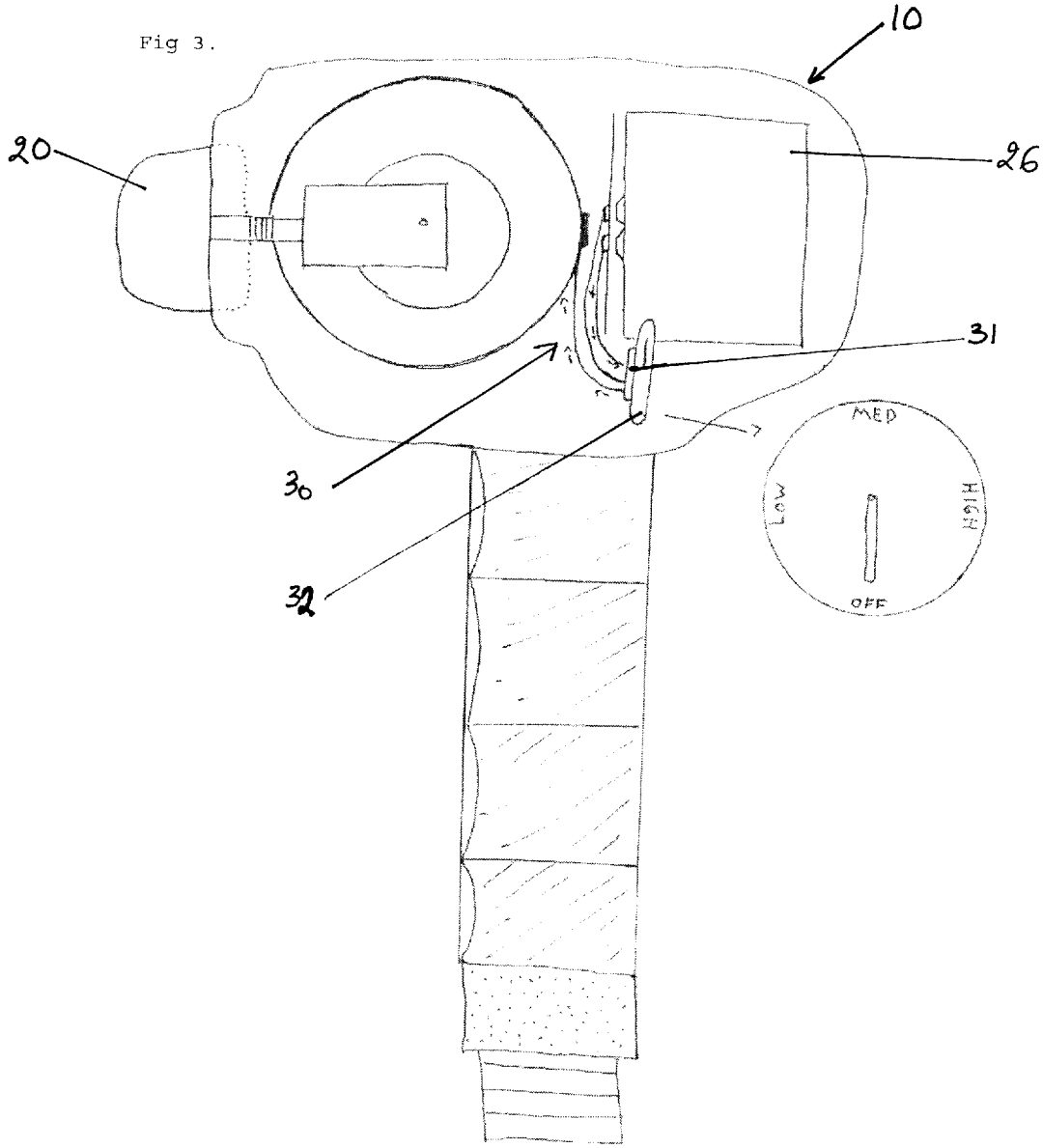
FIG. 3. This view is the left side of the massager. The picture represents the electrical circuit that is made between the battery, the circuit board/speed adjuster, and the electric percussion motor. The electric current moves in the direction just mentioned, with the speed adjuster controlling the amount of voltage brought to the motor. The arrows point to the direction of electric current flow that starts from the battery on the right. The speed adjuster, which controls the amount of voltage brought to the electric motor, is also shown as the circular object with the three levels of intensity (Low, Med, High).

FIG. 3. This is the same view that is described in FIG. 2. This view includes the electrical circuit 30 that powers the massager and gives the user three speeds of percussion massage. The two wires coming from the battery plate are the positive and negative electric currents brought from the battery into the circuit board. The circuit board 31 is located on the back of the percussion speed adjuster dial 32 (Low, Med, High), and the circuit board receives the electric current from the battery. On the circuit board are three options for voltage use in the massager—"Low" using the least voltage and "High" using the most. The wire located at the lowest point of the circuit board runs from the circuit board to the electric motor. The arrow pointing outside the massager points to the design of the percussion speed adjuster dial. The rod in the center of the dial represents the small screw that will spin and allow different levels of voltage to pass through the circuit. This enables the product to have different percussion speeds. The arrows running along the wires point in the direction the current is flowing, starting from the battery.

Figure 4:
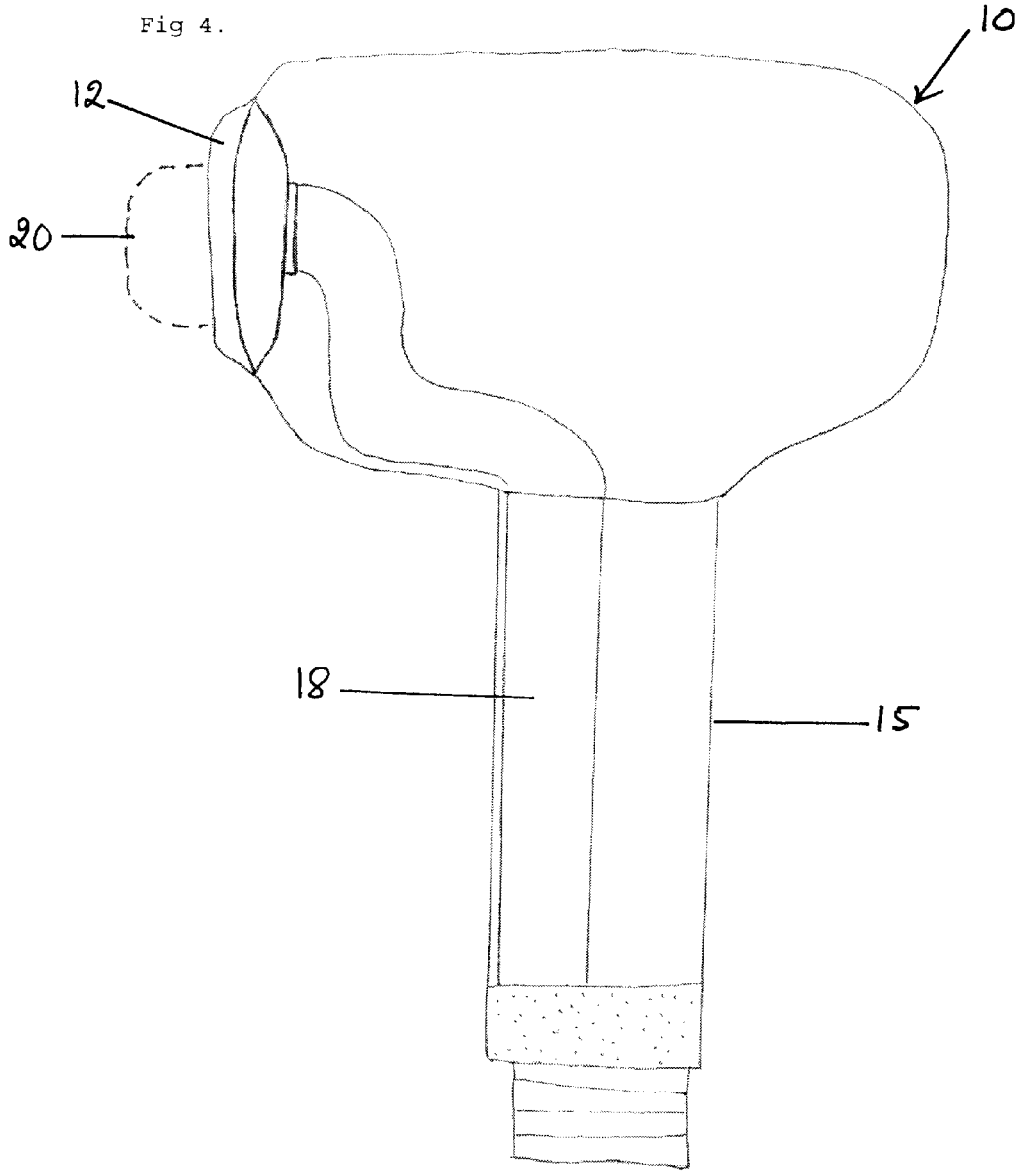
FIG. 4. This is the left side of the massager. This picture shows how the water hose that runs through the handle and along the bottom of the massager and into the showerhead.

FIG. 4. The angle of this view is the same as the previous two. This drawing shows the water hose 18 moving through the handle 15 and into the showerhead 12. The water hose will run underneath the electric motor 21 and attach to the showerhead.

Figure 5:
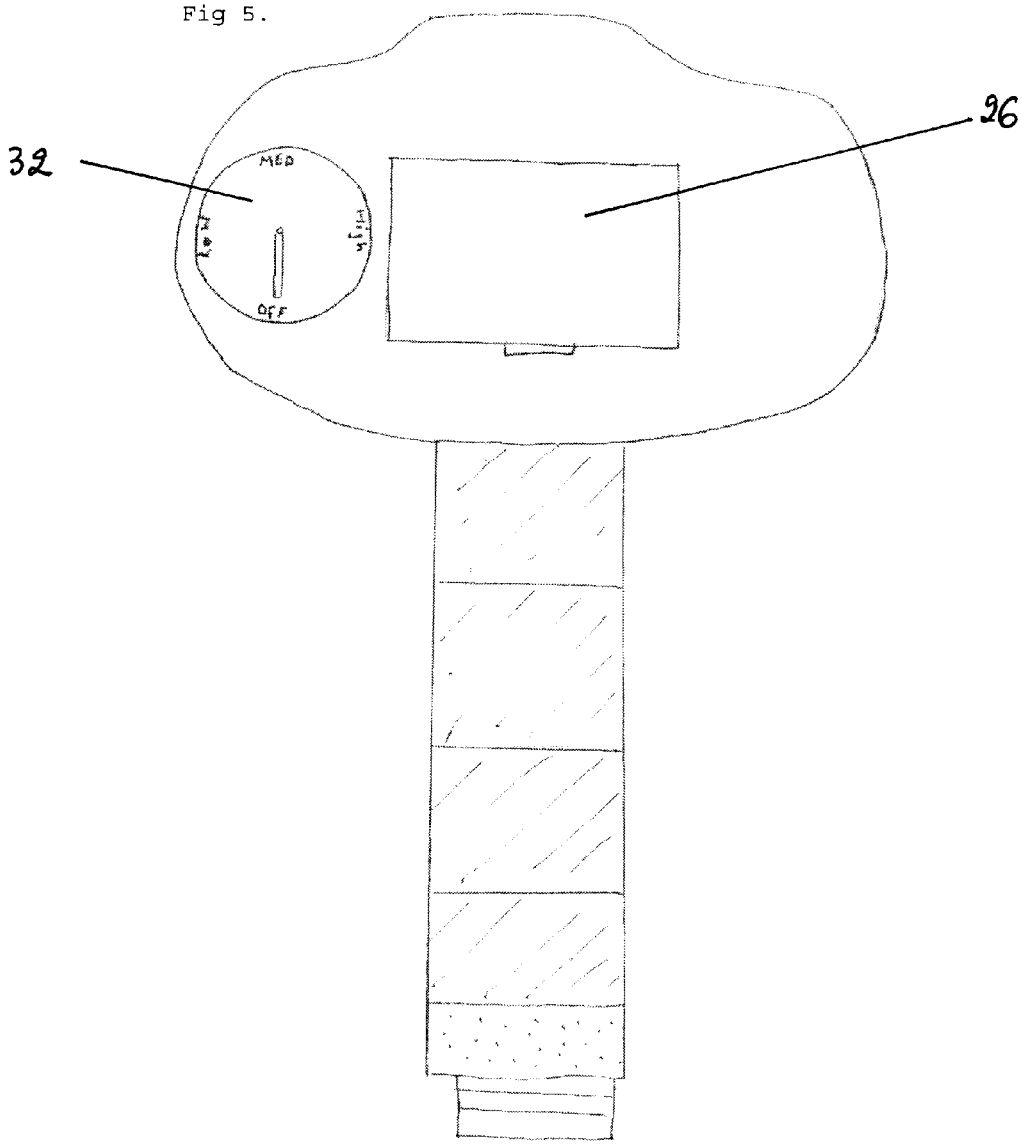
FIG. 5. This is the rear of the massager. The square box symbolizes the space for the rechargeable battery. The circle on the left with the text (Low, Med, High) is the percussion massage speed adjuster, which controls the voltage going to the electric motor.

FIG. 5. This view is taken from the back of the massager 10, it represents the exterior plastic shell of the massager. The square in the center represents the position of the rechargeable battery 26 will be placed in the device and taken from it. The small rectangle under the square represents the clip that will be used to open the first door to the battery. The circle on the left side of the back of the massager is the percussion speed adjuster 32 and it will be placed on the back left side of the massager.

Figure 6:
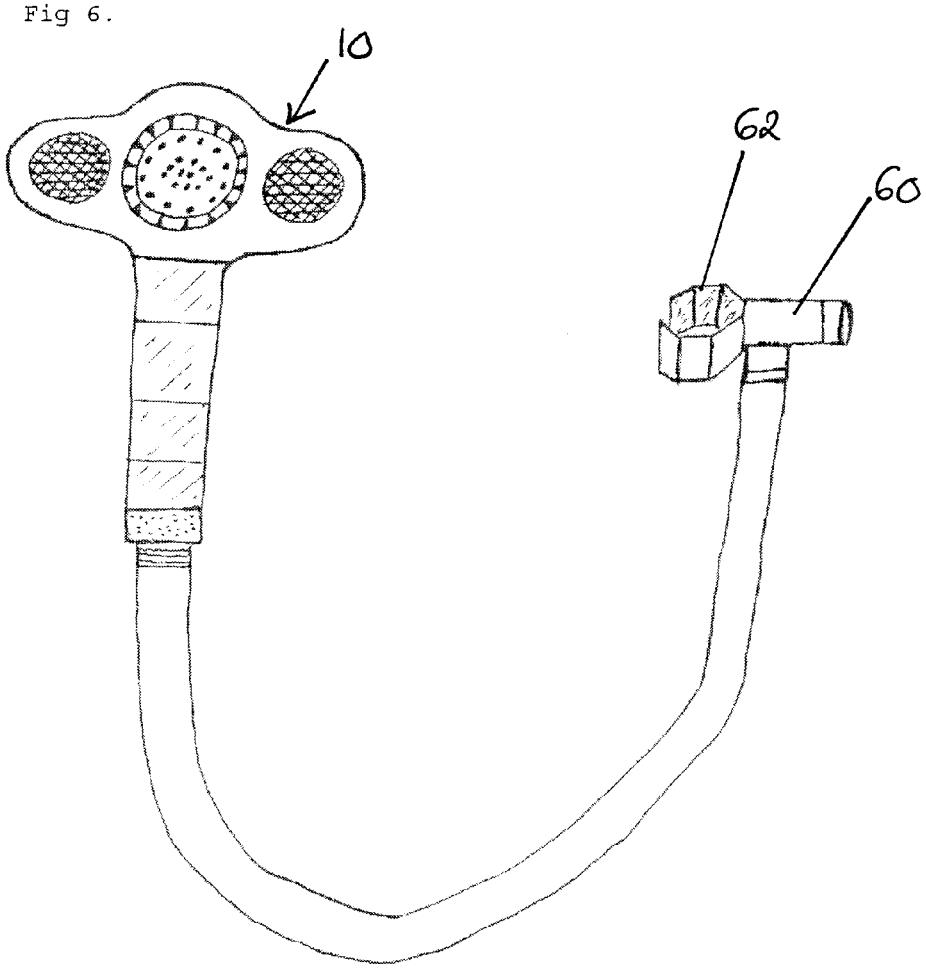
FIG. 6. This view is of the front of the massager and of the whole device. This view shows the connecting hose that runs from the shower faucet into the massager. It is attached by a plastic piece that screws the hitch onto the shower faucet. The hitch is used to hold the massager when the percussion massager is not being used.

FIG. 6. This view is of the front of the massager 10, it shows the complete model. The hose coming from the massager connects with a plastic piece 60 that is screwed onto a shower or water faucet (not shown). The plastic piece also has a plastic clamp 62 that is used to hold the massager in place.

What is claimed is:

1. A hydro-percussion device comprising: a shell including a handle portion and a head portion, said shell having an anterior working side and a posterior side, the shell is adapted to be attached to a source of pressurized water, the shell has three circular openings on the anterior side through which two percussive massage heads and a water pressure dilator are situated, thee posterior side has a voltage controller; the interior of the shell includes a water hose to communicate the pressurized water source to the water pressure dilator, said interior also adapted to hold an electric circuit board, a battery and an electric motor, the electric circuit board including the voltage controller for controlling the speed of the motor, said motor reciprocates the percussive massage heads; and said percussive massage heads include two percussive rubber heads.

2. The hydro-percussion device according to claim 1 further including a rechargeable battery stand in which the device sits for recharging the battery, said stand allows the user to position the device away from water.

* * * * *